US006646600B2

(12) United States Patent
Vail et al.

(10) Patent No.: US 6,646,600 B2
(45) Date of Patent: Nov. 11, 2003

(54) PHASED ARRAY ANTENNA WITH CONTROLLABLE AMPLIFIER BIAS ADJUSTMENT AND RELATED METHODS

(75) Inventors: David Kenyon Vail, West Melbourne, FL (US); Frank J. Tabor, Melbourne, FL (US); Daniel P. Blom, Palm Bay, FL (US); Stephen S. Wilson, Melbourne, FL (US)

(73) Assignee: Harris Corporation, Melbourne, FL (US)

( * ) Notice: Subject to any disclaimer, the term of this patent is extended or adjusted under 35 U.S.C. 154(b) by 40 days.

(21) Appl. No.: 09/991,535

(22) Filed: Nov. 9, 2001

(65) Prior Publication Data

US 2003/0090417 A1 May 15, 2003

(51) Int. Cl.[7] ..... H01Q 3/22
(52) U.S. Cl. ..... 342/372; 342/377
(58) Field of Search ..... 342/368, 371, 342/372, 377; 343/700 MS

(56) References Cited

U.S. PATENT DOCUMENTS

| | | | | |
|---|---|---|---|---|
| 4,859,965 A | * | 8/1989 | Paolella et al. | 330/285 |
| 4,931,803 A | | 6/1990 | Shimko | 342/371 |
| 4,980,691 A | | 12/1990 | Rigg et al. | 342/372 |
| 4,994,814 A | | 2/1991 | Aoki et al. | 342/372 |
| 4,996,532 A | | 2/1991 | Kirimoto et al. | 342/81 |
| 5,008,680 A | | 4/1991 | Willey et al. | 342/372 |
| 5,027,126 A | | 6/1991 | Basehgi et al. | 342/372 |
| 5,072,228 A | | 12/1991 | Kuwahara | 342/360 |
| 5,225,841 A | | 7/1993 | Krikorian et al. | 342/204 |
| 5,231,405 A | | 7/1993 | Riza | 342/375 |
| 5,243,274 A | | 9/1993 | Kelsey et al. | 324/158 R |
| 5,283,587 A | | 2/1994 | Hirshfield et al. | 342/372 |
| 5,353,031 A | | 10/1994 | Rathi | 342/372 |
| 5,432,473 A | * | 7/1995 | Mattila et al. | 330/133 |
| 5,493,255 A | | 2/1996 | Murtojarvi | 330/296 |
| 5,559,519 A | | 9/1996 | Fenner | 342/174 |
| 5,592,179 A | | 1/1997 | Windyka | 342/372 |
| 5,655,841 A | | 8/1997 | Storm | 374/183 |
| 5,680,141 A | | 10/1997 | Didomenico et al. | 342/372 |
| 5,705,940 A | * | 1/1998 | Newman et al. | 326/68 |
| 5,771,016 A | | 6/1998 | Mullins et al. | 342/372 |
| 5,938,779 A | | 8/1999 | Preston | 714/718 |
| 5,990,830 A | | 11/1999 | Vail et al. | 342/368 |
| 5,995,740 A | | 11/1999 | Johnson | 395/500.41 |
| 5,999,990 A | | 12/1999 | Sharrit et al. | 718/8 |
| 6,011,512 A | | 1/2000 | Cohen | 342/372 |
| 6,023,742 A | | 2/2000 | Ebeling et al. | 710/107 |
| 6,157,681 A | | 12/2000 | Daniel et al. | 375/298 |
| 6,163,220 A | | 12/2000 | Schellenberg | 330/295 |
| 6,172,642 B1 | | 1/2001 | DiDomenico et al. | 342/368 |
| 6,278,400 B1 | * | 8/2001 | Cassen et al. | 342/175 |

FOREIGN PATENT DOCUMENTS

GB 2161046 A * 1/1986 ..... H04B/1/44

OTHER PUBLICATIONS

Yuen, C. et al, "A 20 GHz MMIC Power Module For Transmit Phased Array Applications," IEEE MTT–S International Microwav Symposium Digest, Jun. 1996, pp. 1163–1166, vol. 2.*

Sanzgiri, Shashi et al, "A Hybrid Tile Approach for Ka Band Subarray Modules," IEEE Trans. on Antennasand Propagation, vol. 43, No. 9 Sep.1995, pp. 953–959.*

* cited by examiner

*Primary Examiner*—Gregory C. Issing
(74) *Attorney, Agent, or Firm*—Allen, Dyer, Doppelt, Milbrath & Gilchrist, P.A.

(57) ABSTRACT

A phased array antenna may include a substrate and a plurality of phased array antenna elements carried thereby, and an element control module for at least one of the phased array antenna elements. The element control module may include an amplifier coupled to the at least one phased array antenna element and having a controllable bias, and a controllable device coupled to the amplifier and having at least one of a controllable phase, delay, and attenuation. The element control module may also include a control application specific integrated circuit (ASIC) for controlling the controllable phase, delay, and/or attenuation of the controllable device and the controllable bias of the amplifier.

43 Claims, 4 Drawing Sheets

PHASED ARRAY ANTENNA WITH CONTROLLABLE AMPLIFIER BIAS ADJUSTMENT AND RELATED METHODS

FIELD OF THE INVENTION

The present invention relates to the field of communications, and more particularly, to phased array antennas.

BACKGROUND OF THE INVENTION

Antenna systems are widely used in both ground based applications (e.g., cellular antennas) and airborne applications (e.g., airplane or satellite antennas). For example, so-called "smart" antenna systems, such as adaptive or phased array antennas, combine the outputs of multiple antenna elements with signal processing capabilities to transmit and/or receive communications signals (e.g., microwave signals, RF signals, etc.). As a result, such antenna systems can vary the transmission or reception pattern of the communications signals in response to the signal environment to improve performance characteristics.

In such antennas, the antenna elements typically have a respective phase shifter associated therewith. The phase shifters may be controlled by a central array controller, for example, to adjust respective phases of the antenna elements across the array. Similarly, transmission and reception amplifiers are also typically coupled to each antenna element and to centralized transmit/receive circuitry to adjust signal transmission and reception strength. The respective phase shifter and transmission/reception amplifiers for each antenna element may be included in an antenna module, for example.

One example of a prior art antenna module is disclosed in U.S. Pat. No. 5,559,519 to Fenner entitled "Method and System for the Sequential Adaptive Deterministic Calibration of Active Phased Arrays." The antenna module includes a plurality of antenna elements, power amplifiers coupled to the antenna elements, and a pre-amplifier for activating the power amplifiers. A controller is also included which has an output for controlling biasing of the pre-amplifier. The antenna module further includes an attenuator and a phase shifter, and the controller also responds to signals at its input for controlling amplitude at the attenuator and phase at the phase shifter of the antenna element during both transmit and receive modes.

While the above prior art antenna module does include a controller for biasing the pre-amplifier, it does not control the biasing of the power amplifiers. Yet, some phased array elements commonly use monolithic microwave integrated circuit (MMIC) amplifiers, for example, which may require a control voltage to set the bias operating point for the amplifier. This is particularly the case with transmitter amplifiers.

As a result, typical prior art phased array antenna modules include a plurality of resistors, for example, which are arranged to set the bias point. Even so, these resistors are typically fixed resistors installed during manufacture. Further, the same resistor configuration is typically used in each antenna module for convenience, thus the bias value is not individually adjusted for each amplifier. Yet, even small variations in the control voltage, which may still occur with such configurations, can significantly affect amplifier operation.

Another prior art approach to bias adjustment is disclosed in U.S. Pat. No. 6,163,220 to Schellenberg entitled "High-Voltage, Series-Biased FET Amplifier for High-Efficiency Applications." This patent is directed to an integrated circuit two-stage power amplifier including a series-connected active biasing network for biasing RF power cells. The biasing network includes series-connected resistors and series-connected buffer cells connected between the series-connected resistors and the RF power cells. The biasing network may also include a programmable resistor for setting a current in the bias array.

While this approach may provide additional flexibility, such amplifiers may add to design complexities and increased costs.

SUMMARY OF THE INVENTION

In view of the foregoing background, it is therefore an object of the invention to provide a phased array antenna which provides for controllable biasing of transmitter and/or receiver amplifiers of element control modules thereof.

This and other objects, features, and advantages in accordance with the present invention are provided by a phased array antenna including a substrate and a plurality of phased array antenna elements carried thereby, and an element control module for at least one of the phased array antenna elements. The element control module may include an amplifier coupled to the at least one phased array antenna element and having a controllable bias. The element control module may also include a controllable device coupled to said amplifier and having at least one of a controllable phase, delay, and attenuation. The element control module may further include a control application specific integrated circuit (ASIC) for controlling both the controllable phase, delay, and/or attenuation of the controllable device and the controllable bias of the amplifier.

More specifically, the element control module may further include a resistor network coupled between the control ASIC and the amplifier, and the control ASIC may control the controllable bias of the amplifier via the resistor network. The control ASIC may include at least one bias adjust register connected to the resistor network and control logic circuitry for writing digital bias adjust signals (e.g., digital data values) to the at least one bias adjust register. Alternately, the control ASIC may include a resistor network coupled to the amplifier. Also, the element control module may further include a capacitor connected between the resistor network and a reference voltage to reduce noise coupling into the amplifier.

Additionally, the phased array antenna may further include an array controller connected to the element control module for causing the control ASIC to control the controllable bias of the amplifier. The amplifier may be a transmitter and/or a receiver amplifier, for example.

Another aspect of the invention is for a similar phased array antenna including an element control module including an amplifier coupled to the at least one phased array antenna element and having a controllable bias, a resistor network coupled to the amplifier, and a control circuit for controlling the controllable bias of the amplifier via the resistor network by outputting digital bias adjust signals to the resistor network. More particularly, the control circuit may be implemented in at least a portion of an ASIC. Alternately, the resistor network and the control circuit may be implemented in an ASIC.

The element control module may further include a controllable device coupled to the amplifier and having a controllable phase, delay, and/or attenuation, and the control circuit may also control the controllable phase, delay, and/or attenuation of the controllable device. Furthermore, the control circuit may include at least one bias adjust register connected to the resistor network and control logic circuitry for writing digital bias adjust signals (e.g., digital data values) to the at least one bias adjust register.

Additionally, the phased array antenna may include an array controller connected to the element control module for causing the control circuit to control the controllable bias of the amplifier. The amplifier may be a transmission and/or a reception amplifier. Also, the element control module may further include a capacitor connected between the resistor network and a reference voltage, again for reducing noise coupling into the amplifier.

Yet another aspect of the invention relates to an element control module for a phased array antenna element of a phased array antenna. The element control module may include an amplifier to be coupled to the phased array antenna element and having a controllable bias, and a controllable device coupled to the amplifier and having at least one of a controllable phase, delay, and/or attenuation. The element control module may also include a control ASIC. The control ASIC may control both the controllable phase, delay, and/or attenuation of the controllable device and the controllable bias of the amplifier.

Still another aspect of the invention is for an element control module which may include an amplifier to be coupled to the phased array antenna element and having a controllable bias, a resistor network coupled to the amplifier, and a control circuit. As noted above, the control circuit may control the controllable bias of the amplifier via the resistor network by outputting digital bias adjust signals (e.g., digital data values) to the resistor network.

A method aspect of the invention is for controlling biasing of an amplifier coupled to a phased array antenna element. The method may include using a control ASIC, such as the one described above, for controlling a phase, delay, and/or attenuation of a controllable device coupled to the amplifier, and using the control ASIC for also controlling the bias of the amplifier.

Another method aspect of the invention is for controlling a bias of an amplifier for a phased array antenna element and may include coupling a resistor network to the amplifier. Further, the method may also include controlling the bias of the amplifier using the resistor network by outputting digital bias adjust signals (e.g., digital data values) to the resistor network.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime and double prime notation are used to indicate similar elements in alternative embodiments.

Figure 1:
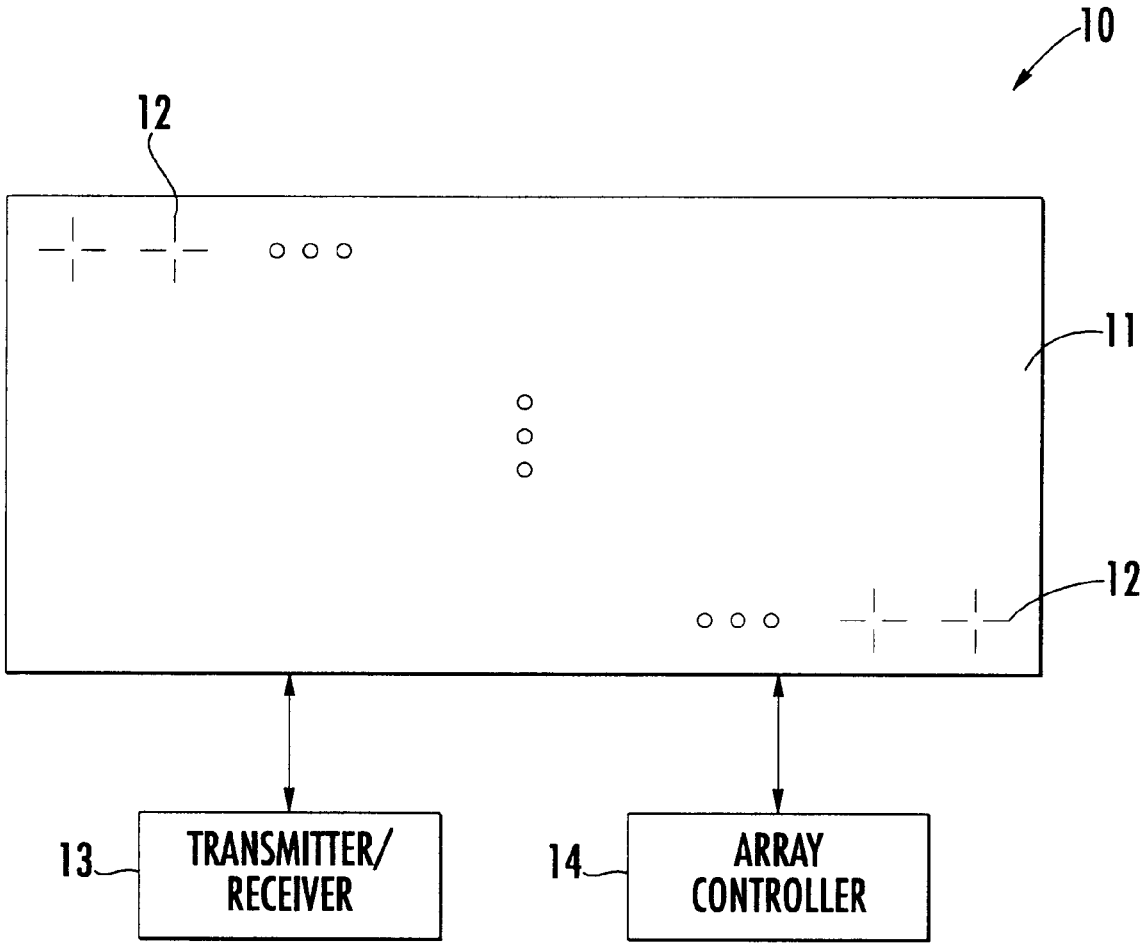
FIG. 1 is schematic block diagram of a phased array antenna according to the present invention.

Referring initially to FIG. 1, a phased array antenna 10 according to the invention includes a substrate 11 and a plurality of phased array antenna elements 12 carried thereby. As used herein, "substrate" refers to any surface, mechanized structure, etc., which is suitable for carrying a phased array antenna element, as will be appreciated by those of skill in the art. The phased array antenna 10 may also include one or more transmitters/receivers 13 for sending and receiving communications signals (e.g., RF or microwave signals) via the antenna elements 12, and an array controller 14, which will be described further below. The phased array antenna 10 may be used for ground, airborne, or spaceborne applications, as will be readily understood by those skilled in the art.

Figure 2:
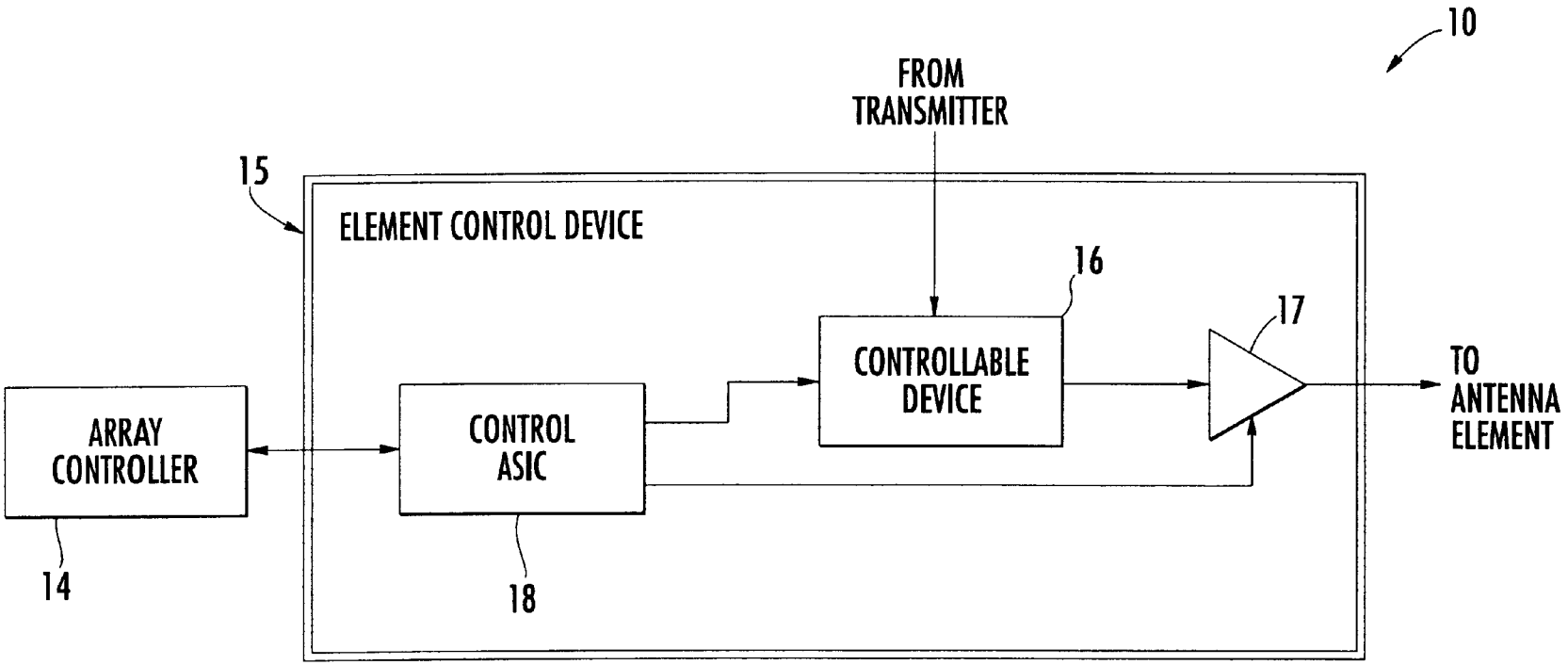
FIG. 2 is a schematic block diagram of an element control module for the phased array antenna of FIG. 1.

Turning now additionally to FIG. 2, the phased array antenna 10 may also include a respective element control module 15 for each phased array antenna element 12. Of course, in some embodiments a single element control module 15 may be used to control more than one phased array antenna element 12, as will be appreciated by those of skill in the art. The element control modules 15 may be carried by the substrate 11, for example, though other suitable mounting configurations known to those of skill in the art are also possible. Each element control module 15 may include a controllable device 16 (such as a phase shifter, delay generator, and/or attenuator, for example) having a controllable phase, delay, and/or attenuation. Furthermore, the element control module 15 may also include a transmitter amplifier 17 coupled to the controllable device 16 and the phased array antenna element 12 and having a controllable bias.

Each element control module 15 may also include a control circuit, such as the control application specific integrated circuit (ASIC) 18, for example, for controlling both the phase, delay, and/or attenuation of the controllable device 16 and the controllable bias of the transmitter amplifier 17. As used herein, ASIC includes not only custom designed integrated circuits but also field-programmable gate arrays (FPGAs) and similar devices. It should be noted that in certain embodiments the controllable device 16 need not be included in the element control module 15. Thus, the control ASIC 18 need not have the capability of controlling the controllable device 16 in such embodiments.

Figure 3:
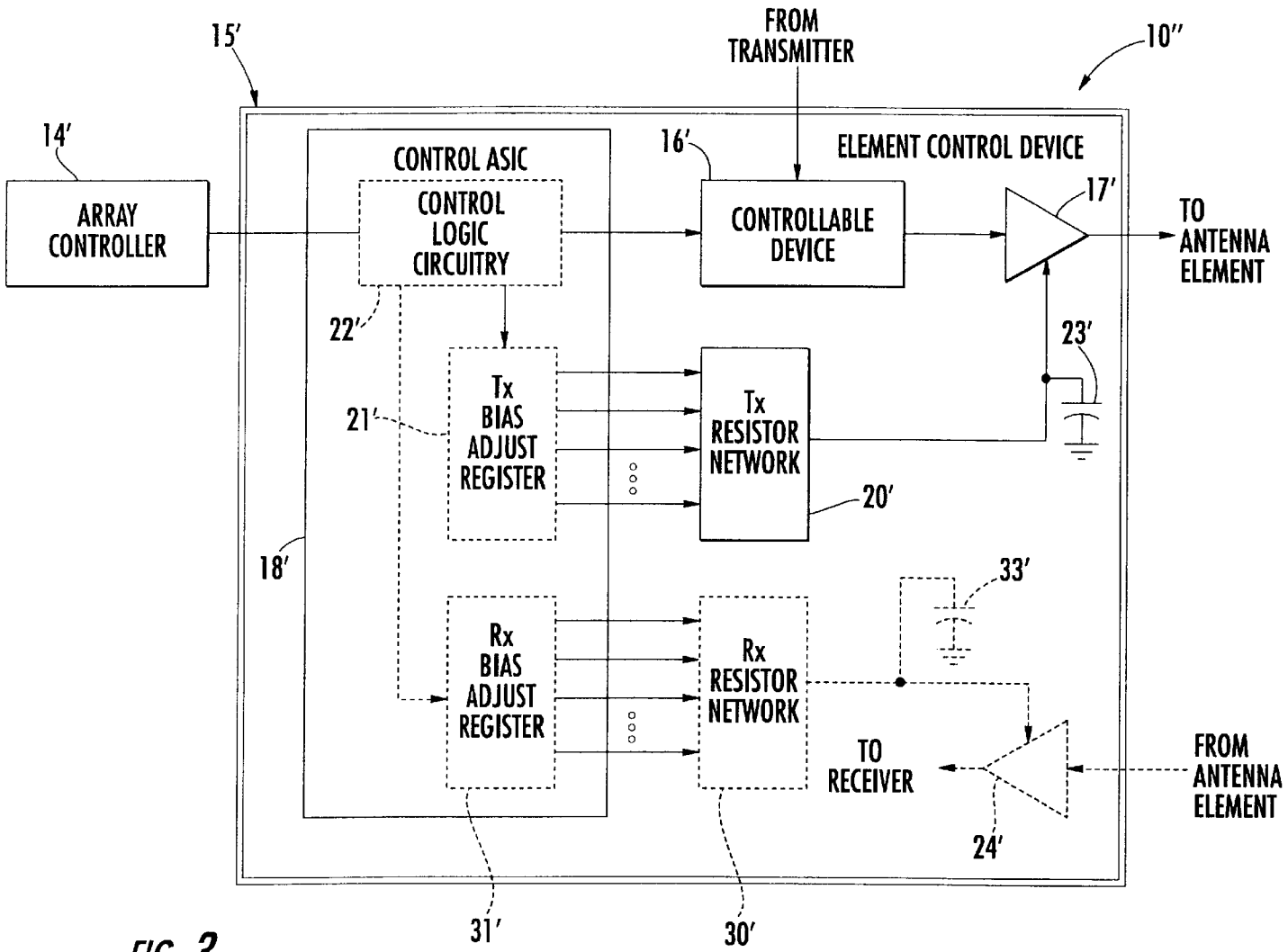
FIG. 3 is a more detailed schematic block diagram of an embodiment of the element control module of FIG. 2.

According to one embodiment of the invention illustratively shown in FIG. 3, the element control module 15' may further include a transmitter resistor network 20' coupled between the control ASIC 18' and the transmitter amplifier 17', and the control ASIC may control the controllable bias of the transmitter amplifier via the transmitter resistor network. By way of example, the transmitter resistor network 20' may be a linear network, such as an R-2R resistor network or variants thereof, or it may be a companding, non-linear network, as will be appreciated by those of skill in the art. Additionally, a filter capacitor 23' may be connected between the transmitter resistor network 20' and a reference voltage (e.g., ground), as shown in FIG. 3, to reduce noise coupling into the transmitter amplifier 17', as will be appreciated by those of skill in the art.

The control ASIC 18' may include one or more transmitter bias adjust registers 21' coupled to the transmitter resistor network 20', and control logic circuitry 22' for writing digital transmitter bias adjust signals to the bias adjust register. The bias adjust register 21' and transmitter resistor network 20' thus provide for a "programmable" bias voltage for the transmitter amplifier 17'. That is, a predetermined number of programmable bias voltages may be used, and this number is determined by the number of digital bias adjust signals used. Of course, some amplifiers may require two bias voltages which differ by a fixed offset, for example. For those cases, a single resistor network 20' with two outputs may be used according to the present invention so that only one bias adjust register is needed to generate both voltages, as will be appreciated by those of skill in the art.

Similarly, the element control module may also include a receiver resistor network 30', and the control ASIC 18' may include one or more receiver bias adjust registers 31' therefor. Here again, a filter capacitor 33' may also be used if desired. Operation of the receiver bias adjust register 31' and receiver resistor network 30' is substantially the same as that of the transmitter bias adjust register 21' and transmitter resistor network 20' and will therefor not be described again for clarity of explanation. Also, the element control module 15 may include either the receiver bias adjust register 31'/receiver resistor network 30 or the transmitter bias adjust register 21'/transmitter resistor network 20', or both, as will be appreciated by those of skill in the art.

By way of example, for the four-bit transmitter bias adjust register 21' illustrated in FIG. 3, there will be $2^4$ (i.e., 16) possible bias voltages for the transmitter amplifier 17' since each digital bias adjust signal (i.e., bit) may assume one of two values, namely logic 1 (e.g., 0 V) or logic 0 (e.g., −3.3 V or −5 V). It will be appreciated by those of skill in the art that any number of digital bias adjust signals may be used to provide more or less bias values as needed for a particular application, and that the transmitter resistor network 20' will generally be designed to provide a specific voltage range required by the particular amplifier being used. Of course, one or more analog bias adjust signals may also be used in some embodiments.

Figure 4:
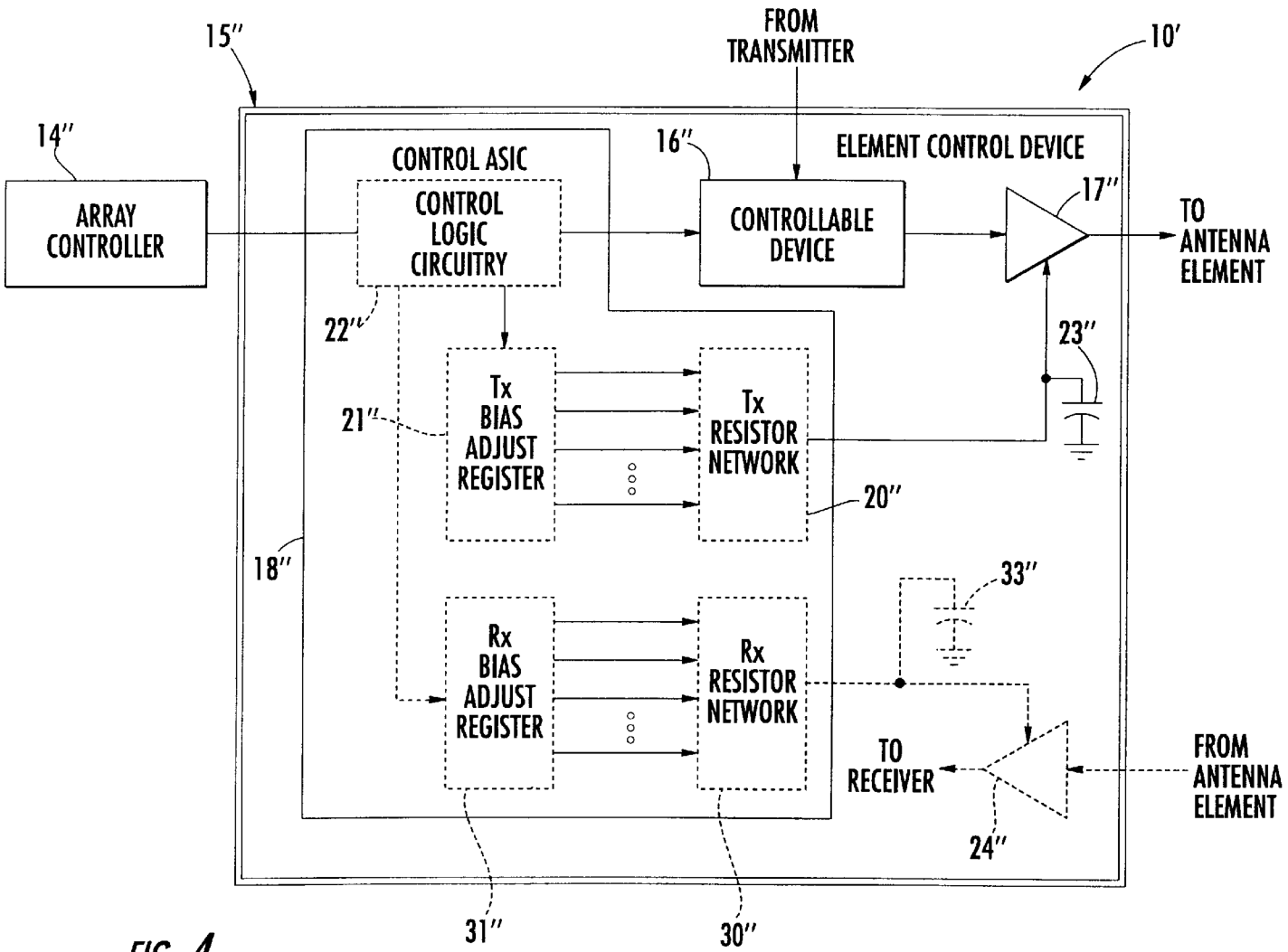
FIG. 4 is a more detailed schematic block diagram of another embodiment of the element control module of FIG. 2.

It will also be appreciated that the above circuitry may be relatively easily incorporated within typical control ASICs used for phased array element control modules. That is, such ASICs may already have sufficient complementary metal oxide semiconductor (CMOS) control logic circuitry, registers, and spare outputs, for example, to implement the above circuitry. Further, as illustratively shown in FIG. 4, in some embodiments the transmitter resistor network 20" and/or the receiver resistor network 30" may be included in the control ASIC 18", if desired. The remaining elements in FIG. 4 are similar to those described in FIG. 3 with like numbers and thus will not be discussed further herein.

Additionally, the array controller 14 is preferably connected to each element control module 15' in the phased array antenna 10. The array controller 14 may cause a respective control ASIC 18' of each element control module 15' to control the controllable bias of its respective transmitter amplifier 17'. In some embodiments, more than one resistor network 20', 30' and respective bias adjust registers 21', 31' may be used, which may be particularly beneficial for amplifiers having multiple biasing inputs. Of course, single resistor network configurations may be used in accordance with the present invention to provide biasing for multiple bias inputs, as will be appreciated by those of skill in the art.

It will also be appreciated by those of skill in the art that the programable biasing provided according to the present invention may simplify the process of initially determining bias voltages during an initial test phase or manufacture of the element control module 15'. Further, the present invention provides a relatively easy and inexpensive capability for adjusting amplifier bias. Particularly, bias changes are possible even after the element control modules 15' are sealed and installed within the phased array antenna 10'. This may not be possible with certain prior art devices, which would otherwise require that the fixed resistors be manually changed to affect such a bias adjustment.

In addition, the present invention allows for different amplifiers across the antenna array to be biased differently, which may significantly increase system performance. For example, the amplifiers may be biased to tune for improved power efficiency, adjust output power, achieve improved frequency response characteristics, compensate for amplifier aging characteristics, etc.

A method aspect of the invention is for controlling biasing of an amplifier (e.g., the transmitter amplifier 17') coupled to a phased array antenna element 12. The method may include using the control ASIC 18', for example, for controlling the phase, delay, and/or attenuation of controllable device 16' and using the control ASIC for also controlling the bias of the transmitter amplifier 17', as previously described above. Moreover, using the control ASIC 18' for controlling the bias may include setting the bias at a constant bias value at least once, such as during an initial test phase, for example. For example, the bias may be set to a default value, and the setting may be optimized.

Another method aspect of the invention is for controlling a bias of an amplifier (e.g., the transmitter amplifier 17') for a phased array antenna element 12. This method aspect may include coupling the resistor network 20' to the transmitter amplifier 17' and controlling the bias of the transmitter amplifier using the transmitter resistor network by outputting digital bias adjust signals to the transmitter resistor network, as previously described above.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A phased array antenna comprising:

a substrate and a plurality of phased array antenna elements carried thereby; and an element control module for at least one of said phased array antenna elements and comprising an amplifier coupled to said at least one phased array antenna element and having a controllable bias, a controllable device coupled to said amplifier and having at least one of a controllable phase, delay, and attenuation, and a control application specific integrated circuit (ASIC) for controlling at least one of the controllable phase, delay, and attenuation of said controllable device, and said control ASIC also for controlling the controllable bias of said amplifier by selectively switching the controllable bias over a range of operating bias voltages based upon at least one output characteristic of said amplifier.

2. The phased array antenna of claim 1 wherein said element control module further comprises a resistor network coupled between said control ASIC and said amplifier, and wherein said control ASIC controls the controllable bias of said amplifier via said resistor network.

3. The phased array antenna of claim 2 wherein said control ASIC comprises:

at least one bias adjust register connected to said resistor network; and control logic circuitry for writing digital bias adjust signals to said at least one bias adjust register.

4. The phased array antenna of claim 2 wherein said element control module further comprises a capacitor connected between said resistor network and a reference voltage.

5. The phased array antenna of claim 1 further comprising an array controller connected to said element control module for causing said control ASIC to control the controllable bias of said amplifier.

6. The phased array antenna of claim 1 wherein said amplifier comprises a transmitter amplifier.

7. The phased array antenna of claim 1 wherein said amplifier comprises a reception amplifier.

8. The phased array antenna of claim 1 wherein said control ASIC further comprises a resistor network coupled to said amplifier.

9. A phased array antenna comprising:

a substrate and a plurality of phased array antenna elements carried thereby; and an element control module for at least one of said phased array antenna elements and comprising an amplifier coupled to said at least one phased array antenna element and having a controllable bias, a resistor network coupled to said amplifier, and a control circuit for controlling the controllable bias of said amplifier via said resistor network by outputting digital bias adjust signals to said resistor network to selectively switch the controllable bias over a range of operating bias levels based upon at least one output characteristic of said amplifier.

10. The phased array antenna of claim 9 wherein said control circuit comprises at least a portion of an application specific integrated circuit (ASIC).

11. The phased array antenna of claim 9 wherein said resistor network and said control circuit are implemented in an application specific integrated circuit (ASIC).

12. The phased array antenna of claim 9 wherein said element control module further comprises a controllable device coupled to said amplifier and having at least one of a controllable phase, delay, and attenuation.

13. The phased array antenna of claim 12 wherein said control circuit also controls at least one of the controllable phase, delay, and attenuation of said controllable device.

14. The phased array antenna of claim 9 wherein said control circuit comprises:

at least one bias adjust register connected to said resistor network for storing and outputting the digital bias adjust signals to said resistor network; and control logic circuitry for writing the digital bias adjust signals to said at least one bias adjust register.

15. The phased array antenna of claim 9 further comprising an array controller connected to said element control module for causing said control circuit to control the controllable bias of said respective amplifier.

16. The phased array antenna of claim 9 wherein said amplifier comprises a transmitter amplifier.

17. The phased array antenna of claim 9 wherein said amplifier comprises a reception amplifier.

18. The phased array antenna of claim 9 wherein said element control module further comprises a capacitor connected between said resistor network and a reference voltage.

19. An element control module for a phased array antenna element of a phased array antenna comprising:

an amplifier to be coupled to the phased array antenna element and having a controllable bias;

a controllable device coupled to said amplifier and having at least one of a controllable phase, delay, and attenuation; and a control application specific integrated circuit (ASIC) for controlling at least one of the controllable phase, delay, and attenuation of said controllable device, and said control ASIC also for controlling the controllable bias of said amplifier by selectively switching the controllable bias over a range of operating bias levels based upon at least one output characteristic of said amplifier.

20. The element control module of claim 19 further comprising a resistor network coupled between said control ASIC and said amplifier, and wherein said control ASIC controls the controllable bias of said amplifier via said resistor network.

21. The element control module of claim 20 wherein said control ASIC comprises:

at least one bias adjust register connected to said resistor network; and control logic circuitry for writing digital bias adjust signals to said at least one bias adjust register.

22. The element control module of claim 20 further comprising a capacitor connected between said resistor network and a reference voltage.

23. The element control module of claim 19 wherein said amplifier comprises a transmitter amplifier.

24. The element control module of claim 19 wherein said amplifier comprises a reception amplifier.

25. The element control module of claim 19 wherein said control ASIC further comprises a resistor network coupled to said amplifier.

26. An element control module for a phased array antenna element of a phased array antenna comprising:

an amplifier to be coupled to the phased array antenna element and having a controllable bias;

a resistor network coupled to said amplifier; and a control circuit for controlling the controllable bias of said amplifier via said resistor network by outputting digital bias adjust signals to said resistor network to selectively switch the controllable bias over a range of operating bias levels based upon at least one output characteristic of said amplifier.

27. The element control module of claim 26 wherein said control circuit comprises at least a portion of an application specific integrated circuit (ASIC).

28. The element control module of claim 26 wherein said resistor network and said control circuit are implemented in an application specific integrated circuit (ASIC).

29. The element control module of claim 26 further comprising a controllable device coupled to said amplifier and having at least one of a controllable phase, delay, and attenuation.

30. The element control module of claim 29 wherein said control circuit also controls at least one of the controllable phase, delay, and attenuation of said controllable device.

31. The element control module of claim 26 wherein said control circuit comprises:

at least one bias adjust register connected to said resistor network for storing and outputting the digital bias adjust signals to said resistor network; and control logic circuitry for writing the digital bias adjust signals to said at least one bias adjust register.

32. The element control module of claim 26 wherein said amplifier comprises a transmitter amplifier.

33. The element control module of claim 26 wherein said amplifier comprises a reception amplifier.

34. The element control module of claim 26 further comprising a capacitor connected between said resistor network and a reference voltage.

35. A method for controlling biasing of an amplifier coupled to a phased array antenna element, the method comprising:

using a control application specific integrated circuit (ASIC) for controlling at least one of a phase, delay, and attenuation of a controllable device coupled to the amplifier; and using the control ASIC for also controlling the bias of the amplifier by selectively switching the controllable bias over a range of operating bias levels based upon at least one output characteristic of the amplifier.

36. The method of claim 35 wherein using the ASIC for also controlling the bias comprises setting the bias at a constant bias value at least once.

37. The method of claim 36 wherein setting the bias at a constant bias value comprises setting the bias at the constant bias value during an initial test phase.

38. The method of claim 35 further comprising coupling a resistor network between the control ASIC and the amplifier; and wherein using the control ASIC for also controlling the bias comprises using the control ASIC for also controlling the bias via the resistor network.

39. The method of claim 38 wherein the control ASIC comprises at least one bias adjust register connected to the resistor network; and wherein using the control ASIC for also controlling the bias comprises writing digital bias adjust signals to the at least one bias adjust register.

40. A method for controlling a bias of an amplifier for a phased array antenna element, the method comprising:

coupling a resistor network to the amplifier; and controlling the bias of the amplifier via the resistor network by outputting digital bias adjust signals to the resistor network to selectively switch the controllable bias over a range of operating bias levels based upon at least one output characteristic of said amplifier.

41. The method of claim 40 wherein controlling the bias of the amplifier comprises setting the bias of the amplifier at a constant bias value at least once using the resistor network.

42. The method of claim 41 wherein setting the bias at a constant bias value comprises setting the bias at the constant bias value during an initial test phase.

43. The method of claim 40 wherein controlling the bias comprises controlling the bias via the resistor network using a control application specific integrated circuit (ASIC).

* * * * *